US007254952B2

(12) United States Patent
Lilke

(10) Patent No.: US 7,254,952 B2
(45) Date of Patent: Aug. 14, 2007

(54) MODULAR WINE CELLAR AND WINE STORAGE SYSTEM

(76) Inventor: Harvey D. Lilke, 50 Paramount Road, Winnipeg, Manitoba (CA) R2X 2W3

( * ) Notice: Subject to any disclaimer, the term of this patent is extended or adjusted under 35 U.S.C. 154(b) by 152 days.

(21) Appl. No.: 10/984,952

(22) Filed: Nov. 10, 2004

(65) Prior Publication Data

US 2005/0132718 A1 Jun. 23, 2005

(51) Int. Cl.
*F25B 21/02* (2006.01)

(52) U.S. Cl. ..... 62/3.6; 62/457.8

(58) Field of Classification Search ..... 62/3.6, 62/371, 457.1, 457.3, 457.5, 457.8
See application file for complete search history.

(56) References Cited

U.S. PATENT DOCUMENTS

| | | | | | |
|---|---|---|---|---|---|
| 3,606,023 | A | * | 9/1971 | Edmunds | 211/74 |
| 3,754,408 | A | | 8/1973 | Littleton | |
| 3,804,482 | A | | 4/1974 | Smith | |
| D271,550 | S | * | 11/1983 | McMillan | D6/188 |
| 4,567,989 | A | * | 2/1986 | Hurst, Jr. | 211/74 |
| 4,691,274 | A | * | 9/1987 | Matouk et al. | 363/141 |
| 5,343,712 | A | * | 9/1994 | Gowan | 62/126 |
| 5,343,816 | A | * | 9/1994 | Sideris | 108/94 |
| 5,758,513 | A | | 6/1998 | Smith | |
| 5,848,534 | A | | 12/1998 | Stauffer | |
| 6,113,198 | A | | 9/2000 | Hommes | |
| 6,607,105 | B2 | | 8/2003 | Phelps et al. | |

* cited by examiner

*Primary Examiner*—Melvin Jones
(74) *Attorney, Agent, or Firm*—Adrian D. Battison; Michael R. Williams; Ryan W. Dupuis

(57) ABSTRACT

A wine storage system is formed by a modular frame defined by upright members and cross members arranged to form a three dimensional array of compartments in rows and columns where the upright members and cross members have interconnections therebetween allowing addition of further members to form frames of different sizes in a modular construction. Each compartment is arranged to receive an independent wine cell having an insulated rectangular housing with a door and a semi-conductor or other based cooling element inside the housing for cooling the wine bottles. A modular electrical supply arrangement provides a single connection for the modular frame and a connector on each compartment for the housing as it slides into the compartment. Some of the housings can be replaced by less expensive knock down or collapsible non-cooling racks for temporary storage. Alternatively the modular frame can be clad by panels and doors and insulated with a central chilling system cooling all the bottles in each of the compartments simultaneously.

19 Claims, 5 Drawing Sheets

MODULAR WINE CELLAR AND WINE STORAGE SYSTEM

This invention relates to a wine storage system which uses cooling and provides a modularly increasable capacity.

BACKGROUND OF THE INVENTION

The most common wine cellars incorporate insulated wood panel walls and doors with built in refrigeration cooling units. This type of design accounts for most all larger wine storage systems and these models can be custom made according to a buyer's discretion and perhaps space limitations. The majority of smaller self-contained wine storage systems are made from metal cabinets similar to refrigerator designs and incorporate glass display doors.

Refrigerated Wine Cellars are made in a variety of standard and custom designs and are available from many sources in the marketplace. There are similarities between most all models being sold and the differences range between design variations, construction features as well as the prices but the basic design and operation principles are the same whereas they use a self contained and centralized refrigeration unit(s) to cool the stored wine at desired temperature. Temperature controlled wine storage optimizes the flavor and maintains the long-term quality of all wines. All wine cellars are equipped with racks whereby the bottles lay flat to maintain moisture to the corks which prevents drying and air entering the bottle which will compromise the quality of the wines. The size, design and expense of wine cellars are factors which may attract or possibly detract a buyers interests. The present size of a wine collection is also an important consideration due to many owners continuously add to their collections and this requires additional storage facilities.

A most recent introduction into the marketplace is the Semi-Conductor or Electro Thermal cooling system(s). This new technology allows cooling function with no vibration from moving parts and no refrigerants as compared with conventional cooling systems.

The semi-conductor systems do however have a lesser cooling capacity than conventional systems and this factor presently allows use only for specific applications where the cooling recovery demand may be lower than a conventional refrigerator for instance. This system does however have a significant advantage in such applications as a wine cellar whereby the doors are not opened as frequently as a refrigerator and the owners simply wish to maintain the environment and temperature of their wines over a long period of time. Wine Cellars which utilize semi-conductor cooling systems are able to maintain the desired temperatures of wine (55 F–63 F) in a highly efficient and economical manner.

A growing variety of semi-conductor wine cellars are already making entry into the marketplace however all present day models are smaller "free standing" units, which are limited in size.

Some examples of prior art designs for wine storage and dispensing systems are shown in U.S. Pat. No. 6,607,105 (Phelps) issued Aug. 19, 2003, in U.S. Pat. No. 3,804,482 (Smith) issued Apr. 16, 1974 and in U.S. Pat. No. 5,758,513 (Smith) issued Jun. 2, 1998.

SUMMARY OF THE INVENTION

It is one object of the present invention to provide an improved wine storage system which makes use of the advantages of the Semi-Conductor or Electro Thermal cooling system.

According to one aspect of the invention there is provided a wine storage apparatus comprising:

a modular frame defined by upright members and cross members arranged to form a three dimensional array with a front face and a rear face spaced rearwardly from the front face;

the upright members and cross members having interconnections therebetween allowing addition of further members to form compartments of different sizes in a modular construction;

the modular frame defining a plurality of rectangular compartments with each compartment having an open front at the front face of the modular frame with the compartments stacked one on another in a row of the compartments forming one module of the modular frame with the modules side by side;

panels mounted on sides of the modular frame for closing the sides of the modular frame to form an enclosure;

a plurality of wine bottle storing members each shaped and arranged to be received in a respective one of the compartments;

and a cooling system for cooling at least some of the compartments.

Preferably the modular frame is formed from metal rails but other materials may also be used such as wood.

In one preferred arrangement, there is provided a plurality of independent wine cooling containers (wine cells) each comprising:

an insulated rectangular housing having an open front;

the housing being shaped and arranged so as to fit into a respective one of the compartments;

the housing being arranged so that it is readily removable from the compartment;

an array of bottle mounting members within the housing for stacking a plurality of wine bottles within the housing for insertion and removal through the front of the housing;

a door on the front of the housing arranged to allow opening of the door and access to the wine bottles within the container while the container is within the compartment;

and a cooling element associated with the housing for cooling the wine bottles within the housing, the cooling element being independent of cooling elements in others of the housings;

whereby the cooling system is formed by the individual cooling elements of the plurality of wine cells.

Preferably each of the cells has the cooling element mounted within the insulated housing.

Preferably the cooling element includes a semi-conductor or other cooling component.

Preferably the electrical connection is mounted in or associated with the modular frame so as to be part of the modular frame.

Preferably the electrical connection is modular so as to provide an electrical outlet for each compartment and a single electrical connection to an electrical power outlet.

Preferably each container is arranged as a sliding fit within the respective compartment so as to be slidable from the front into the compartment to be wholly contained therein. Thus the cross members at right angles to the front face may form rails on which the housing slides. The housing may be shaped with members which cooperate with the rails in the sliding action and maintain the housing properly supported within the frame Preferably the compartments are arranged relative to the electrical connection such that sliding of a housing into its compartment causes engagement with the electrical connection of that compartment.

Preferably the containers are arranged side by side and top to bottom such that the doors cover substantially the whole front face.

Preferably the compartments are arranged in an array of rows and columns such that the doors cover substantially the whole front face.

Preferably the doors are arranged substantially edge to edge.

The doors may have glass inserts or otherwise solid wood.

As an alternative to some of the wine cells, there are provided additional wine storage racks which are not cooled wherein the modular frame can be filled with one or more wine cells and one or more additional wine storage racks each in its respective compartment.

Preferably each additional wine storage rack comprises a knock down or collapsible rack which can be readily assembled to form a rectangular structure matching the size of a compartment.

Preferably each modular section of the modular frame is closed by a respective front door.

In an alternative arrangement, panels at sides of the rack are insulated for example by boards of insulation material applied over the modular frame with grooves formed in the boards for receiving the cross members.

In this design, there is provided a central cooling system for cooling all the compartments.

The design represented herein is of a modular design, which allows the owner to add additional cooling and/or storage capabilities as he or she may add to their wine collection.

The system introduced herein can be designed to most any size room and can be expanded as the owners wine collection may grow in the future. The system is multi functional to serve as a combination wine cellar and/or storage system.

The new concept herein utilizes the semi-conductor system or other cooling system in a strategic new way whereby multiples of wine cooling cells (hereinafter referred to as "WCC") can be stacked above one another or placed side by side in any plurality of placement considerations. The system can be configured into a specific shape and the exterior sides be enclosed with a wide variety of high quality veneered paneling or other materials to create a wine room, or otherwise two or more wall rack sections may be enclosed in similar paneling to design a conventional style wine cellar. There are no limitations other than the owner or designers imagination.

Each WCC will hold for example 28 bottles, or sizes as may otherwise be decided in the future, and will be a square design cabinet, with insulation (typically foam) so that it will maintain a temperature over extended time frame. It is equipped with a semi-conductor cooling system and a glass front door to allow visual observation of the wine bottles inside. It has a digitally controlled temperature system, which can be adjusted upwards, or down according to the owners preference and/or depending upon the type of wine (white, red or champagne) each requiring different temperature settings.

This unique system is energy efficient and environmentally friendly and a further overall advantage over those systems in the marketplace, it provides a "works in a drawer" type of operating efficiency and maintenance considerations. With most wine cellars, if or when a problem may occur it can mean that the entire wine collection will gain temperature in the event of failure. With the WCC design there is capability to replace or remove a single WCC without compromising or disturbing the entire wine collection.

Each individual WCC in fact becomes an independent wine cellar once it is placed within the specially designed modular wall rack system which has electrical power supply wired in and which is equipped with adapter fittings which mate to the WCC once placed or pushed into position within the modular system. Once positioned in the modular frame a transfer of electrical current energizes the WCC and the temperature settings may then be set to commence the cooling cycle. The electrical modular systems are designed in such a manner that they can be stacked side by side or upwards to accommodate as many additional WCC units as the owner may wish to add or otherwise according to available space.

A unique "quick rack" component (collapsible or knock down wine rack) is also available, which has the same external dimensions as the WCC compartments when opened. Such wine rack component fits firmly and directly into the modular system whereby it will become a conventional bottle storage system. These racks can be easily removed and replaced with WCC units as the owner may decide. These specially designed "quick racks" are made specifically to fit the modular wall rack system. The quick racks are designed so that they collapse/knock down for easy storage and shipping and will open and lock in position for easy insertion into the modular system. Such feature will allow the buyer to utilize the modular system for conventional bottle storage until such time as they may wish to add more WCC units to better protect their growing wine collection. As noted, the modular system can be utilized in various manners, which would not be limited to a singular wall.

The potential applications of such a modular system includes private homes, restaurants, and wine stores, etc., and they may serve as excellent gifts for those who appreciate wine and wish to collect or expand their collection over time. Amongst the many unique advantages noted for this DIY designed system, the sellers may anticipate that each future owner may become more of a collector over time whereby they will eventually require multiples of the available components to enhance and maintain their growing wine collection.

The integrated WCC system is designed to compliment the enjoyment and appreciation of many great wines, and like these great wines our WCC system likewise reveals "once you try them, you may want more".

BRIEF DESCRIPTION OF THE DRAWINGS

One embodiment according to the present invention is described in conjunction with the accompanying drawings in which.

DETAILED DESCRIPTION

Figure 1:
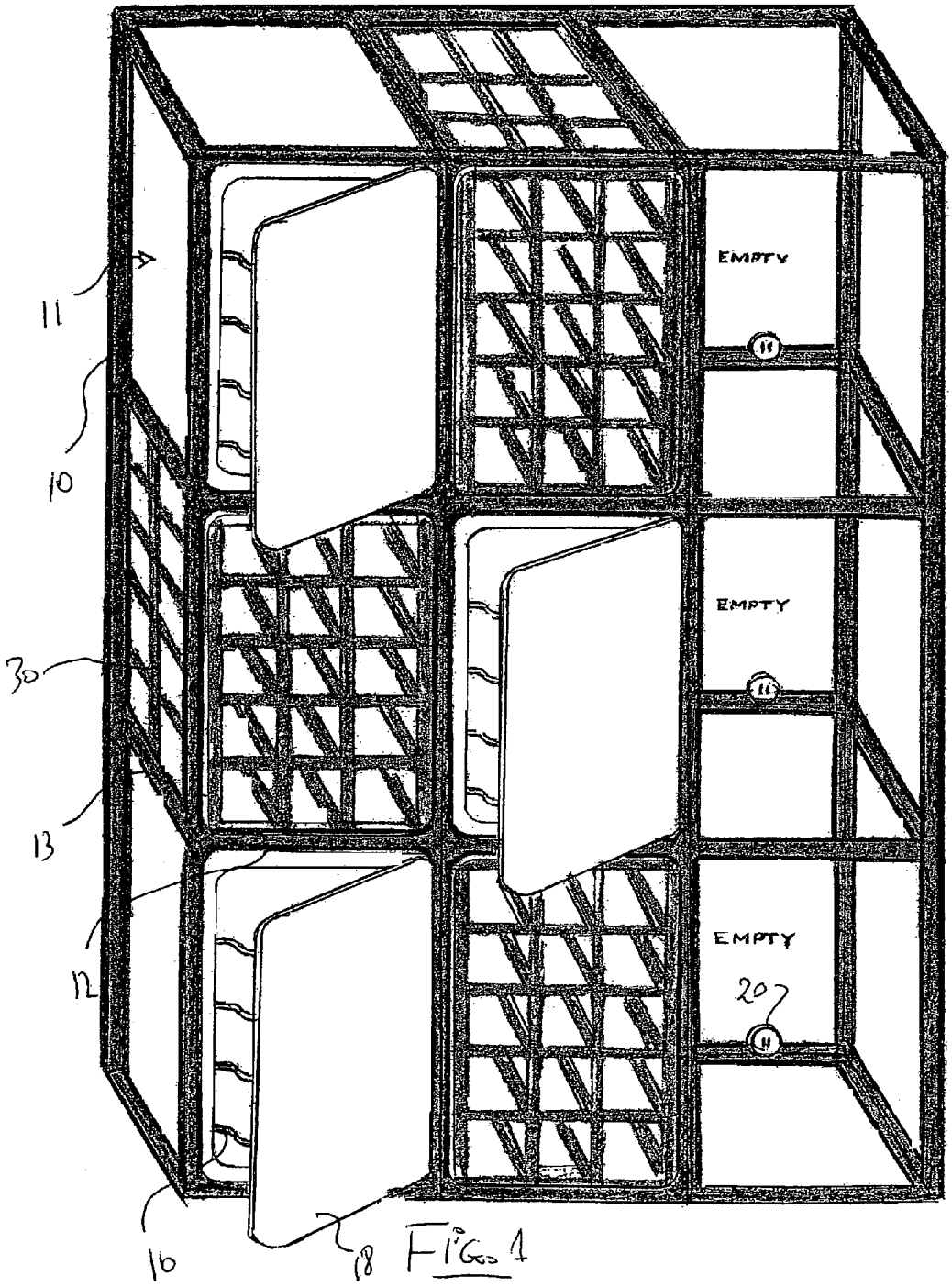
FIG. 1 is an isometric view of a modular frame containing some cooling containers and some foldable/knock down non-cooling racks with some of the compartments empty to show the structure of the modular frame.
Figure 2:
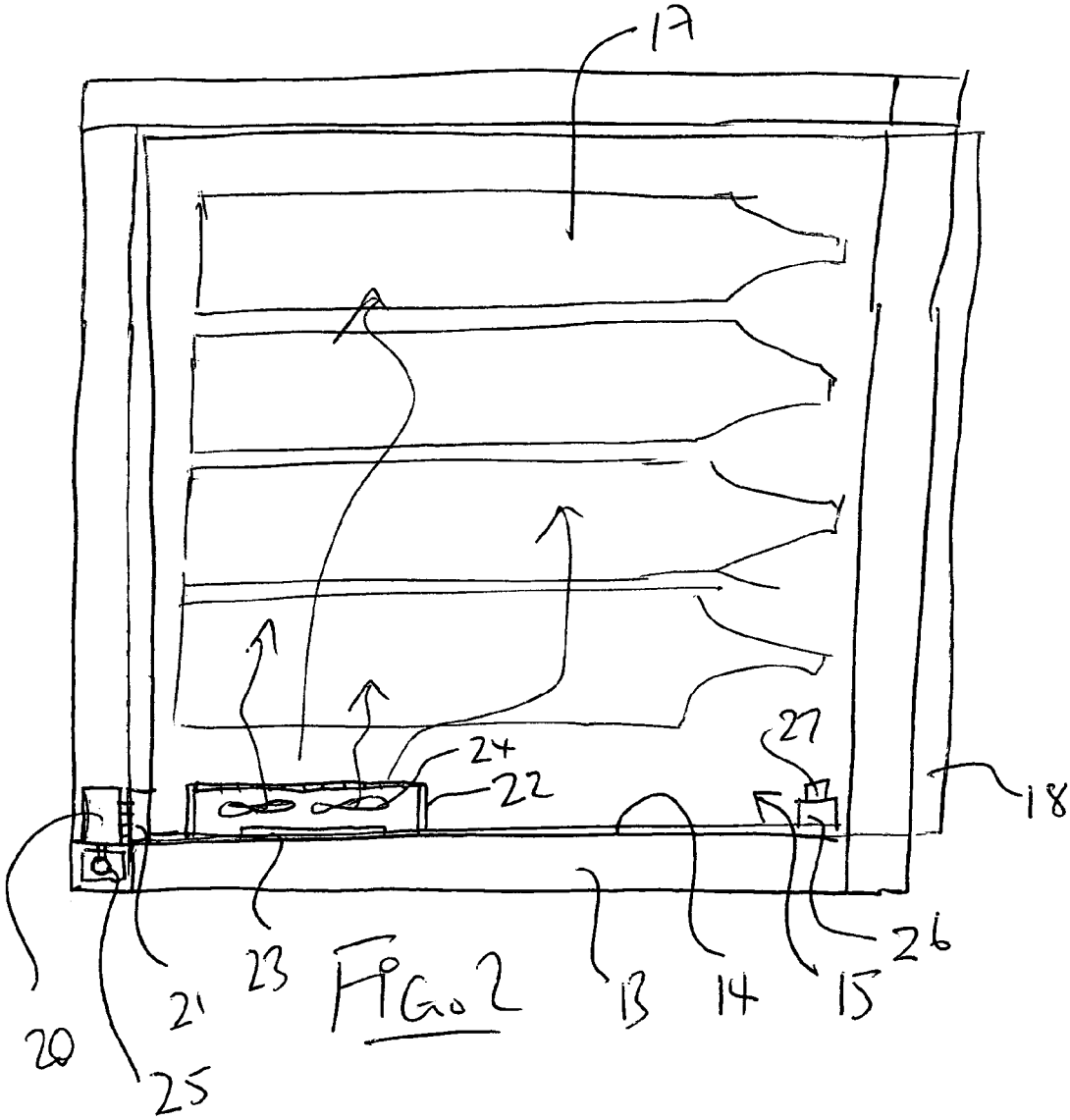
FIG. 2 is a cross sectional view of one container in the modular frame.

In FIG. 1 is shown the modular storage system according to the present invention which includes a framework 10 formed of uprights and cross members to form a plurality of compartments 11 arranged in rows and columns. In the arrangement shown there are nine such compartments arranged in three rows and three columns but the frame structure is modular so that it can be increased in height and increased in width to change the number of compartments. The uprights may be continuous and interconnected by horizontal transverse individual cross members 12 extending in the front and rear planes of the frame together with individual cross members 13 extending at right angles to front and rear planes. Many techniques are available for arranging and constructing this modular design to allow interconnection between the uprights of the cross members and allow formation of the structure in a modular form by which the number of compartments can be increased both in the vertical and horizontal directions. Persons skilled in this art have available to them a number of techniques for connecting of the frame elements any one of these different techniques available may be used.

The frame provides a rigid structure with the compartments maintained at the required dimension and at the required angle.

In each compartment the members 13 form slide rails allowing a bottom surface 14 of a cooling container 15 to slide in through the open face at the front of the cell into the cell to butt the rear of the compartment. The container may extend through into the area defined by the rear rails or may butt against the front surface of the rear rails. The container fills the area defined by the rectangular compartment in vertical and both horizontal directions so that the compartment is dimensioned to just receive the containers. Each container includes rack members 16 for supporting bottles 17 within the container in seven columns of four rows making a total of 28 bottles within the cooling container. A transparent door 18 is located on hinges at one side of the container and covers the whole of the container with outer peripheral supporting or stiffening edge so the door is simply constructed and covers the whole of the open front face of the compartment. Thus when closed the doors are arranged substantially edge to edge which may extend over to cover also the front faces of the frame members in a situation where the door is in front of the front surface of the frame members.

An electrical receptacle 20 is provided at the rear of the frame for connecting to a plug 21 carried on the rear of the container or cell. Thus the sliding action of the container over the slide rails 13 accurately moves the plug 21 to the receptacle 20 and causes it to be inserted into the receptacle providing an electrical connection from the receptacle to a cooling element 22 at the bottom of the housing within the housing. The cooling element 22 comprises a semi-conductor cooling element 23 and fans 24 which direct air from the cooling element through the interior of the housing.

The receptacle 20 is electrically connected through the interior of the frame by electrical connection 25. The electrical connection is preferably arranged so that assembly of the frame also provides the necessary electrical connection of one frame element to the next thus generating a bus structure formed by the frame which allows communication of electrical power to the receptacle and thus to the cooling components within the housing. The electrical connection is preferably at mains voltage (generally 110 V) but can be provided at low voltage such as 12 Volts if preferred for enabling the electrical connections to be formed with less danger of electric shock.

The walls of the containers are insulated so that each container is insulated from the next. Each container has its own control unit 26 which can be located on or just inside the door 18 with control buttons 27 allowing manual control of the temperature which uses a thermostat to control the supply of power to the cooling element 22.

As the containers are mounted within the frame and can be covered at the sides and rear by suitable aesthetic panels, the exterior surface of the walls of the modular frame are designed as high end furniture design appearance so they may blend into a modern furniture décor.

As shown in FIG. 1, some of the containers can be omitted for economy reasons, for example when additional bottles are to be stored but there is no necessity for them to be maintained cooled and thus the necessary financial outlay to purchase the modular containers is not made. In this case racks 30 can be provided which are of a simple construction which can be knock down design or folded flat for transportation by folding diagonally. Thus when the racks are to be inserted, they can be assembled simply by pressing the structure from the flat condition in a diagonal direction assembling the structure and inserting it when rectangular into the frame which acts to maintain the structure in its rectangular orientation defining the individual compartments one for each bottle. As shown the number of bottles contained can be increased due to the extra space available since the structure is not insulated and does not include the cooling components. Such knock down or collapsible racks can be manufactured from a variety of materials for cost savings. Thus an owner of a modular wine storage system as shown can purchase further frame elements to increase the dimensions of the structure quickly using the known assembling technique and can then insert one or more of the temporary collapsible racks into the further available compartments, making the financial outlay to purchase the more expensive cooling containers at a later time.

Instead of the foldable/knock down rack structure, an alternative arrangement (not shown) may be formed by injection molded front a rear flat panels with receptacles formed therein for wooden (or other material) inserts bridging between the panels and acting to define an array supporting the bottles and removable to form a readily collapsible rack.

Figure 3:
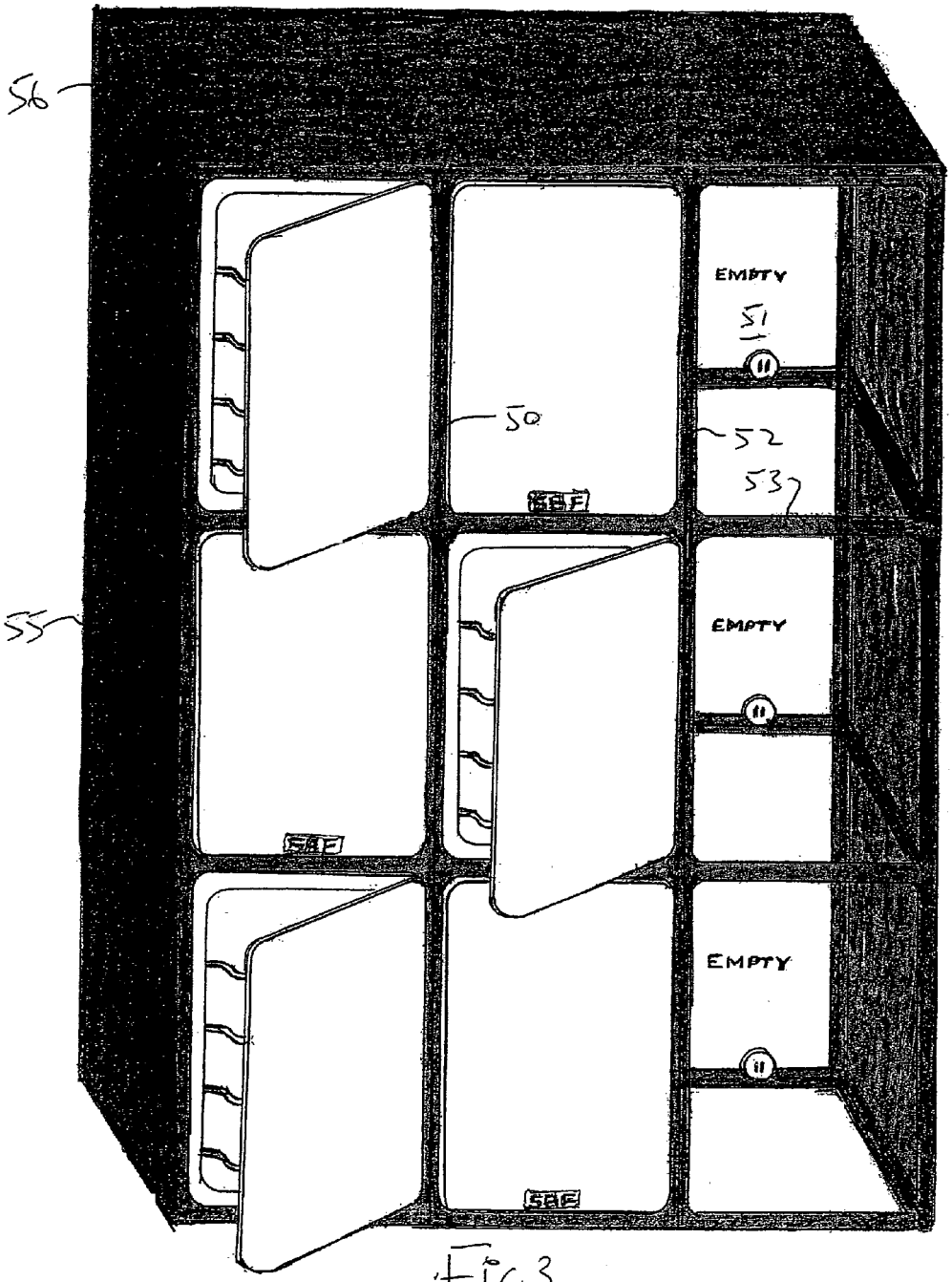
FIG. 3 is an isometric view similar to that of FIG. 1 including side panels forming an enclosure.

FIG. 3 shows the storage apparatus with the frame indicated at 50 formed by the cross members and vertical members in a modular manner to define the individual compartments 51. Thus the frame includes vertical members 52 and horizontal members 53 which are connected together at corners to provide a stack of three such compartments each on top of the next forming a row which defines a single module of the structure. The frame can therefore be assembled with the vertical members and the cross members suitably connected to form two modules side by side and in addition further modules can be attached to show three such modules or more as required by the customer. The side panels 55 cover the side walls and a top panel 56 covers the top. Additional modules are added in the center between the two outside modules thus requiring an increased length at the top panel or an additional component of the top panel and additional front door.

Figure 4:
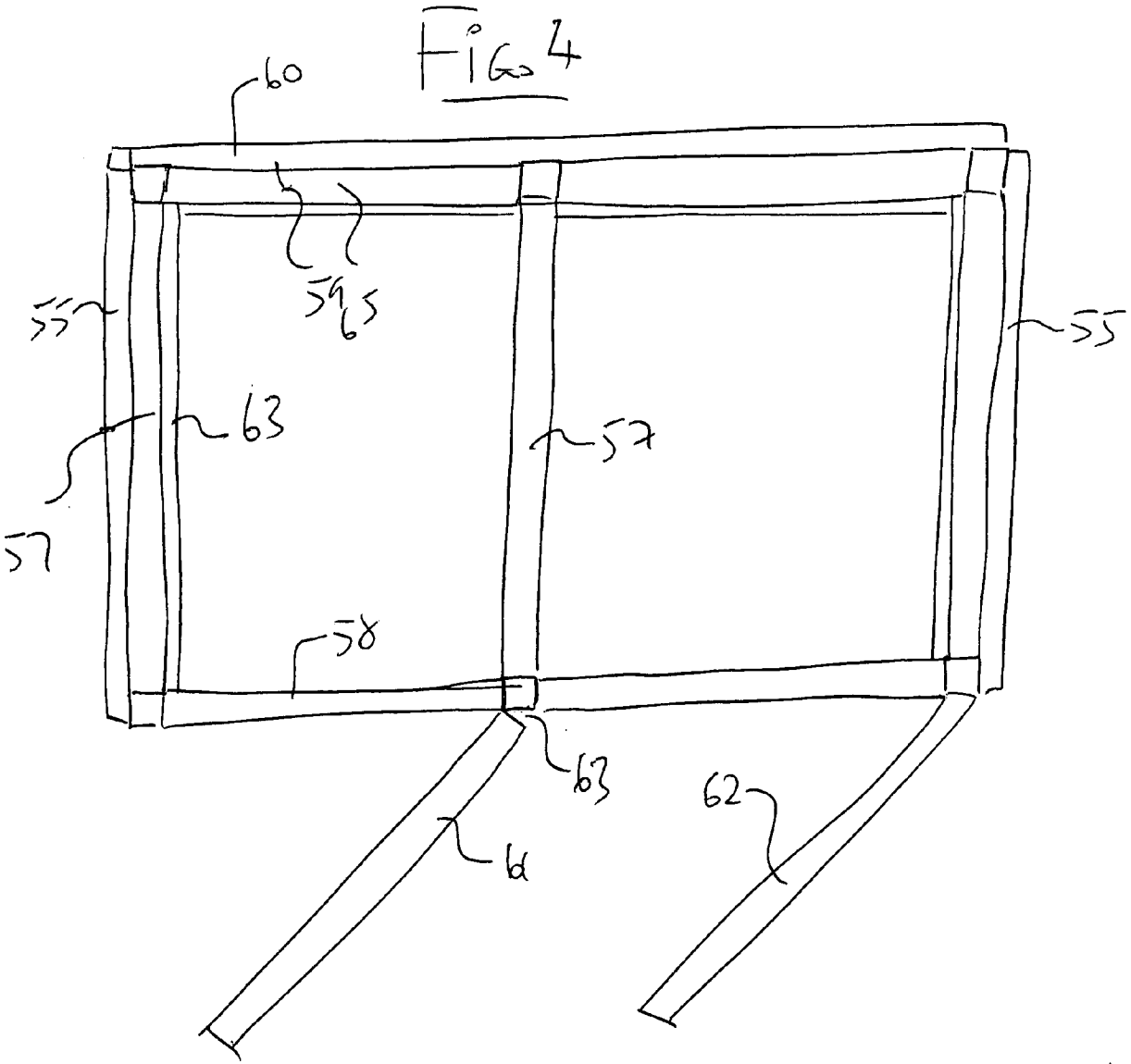
FIG. 4 is a horizontal cross sectional view of the modular frame including insulation panels on the interior and showing exterior doors.

In FIG. 4 the same construction is shown including horizontal rails 57 which extend from the front 58 to the rear 59 of the structure. The rear is covered by a panel 60 and the front is covered by a series of independent doors 61 and 62 which are hinged at 63 to one side of the individual modules so as to cover one module formed by the stack of three compartments.

The structure can also be insulated by interior panels 63 of an insulating material which is formed of a height to cover the full extent of the module with cutout grooves 64 covering the rails 57. Similar panels 65 are applied at the rear so as to cover the rear transverse rails. In this way a single sheet is applied on the inside of the outer panels and covers the whole area as a single insulation sheet of a stiff foam material and also covers the rails so that the rails are no longer exposed.

The front and rear rails carry a wine cell or rack 67 which sits on the front and rear rails and extends therebetween to define a base for each of the compartments. This base can receive either the cooling container previously described and shown in FIG. 3 or the non-cooled simple collapsible rack shown in FIG. 1.

Figure 5:
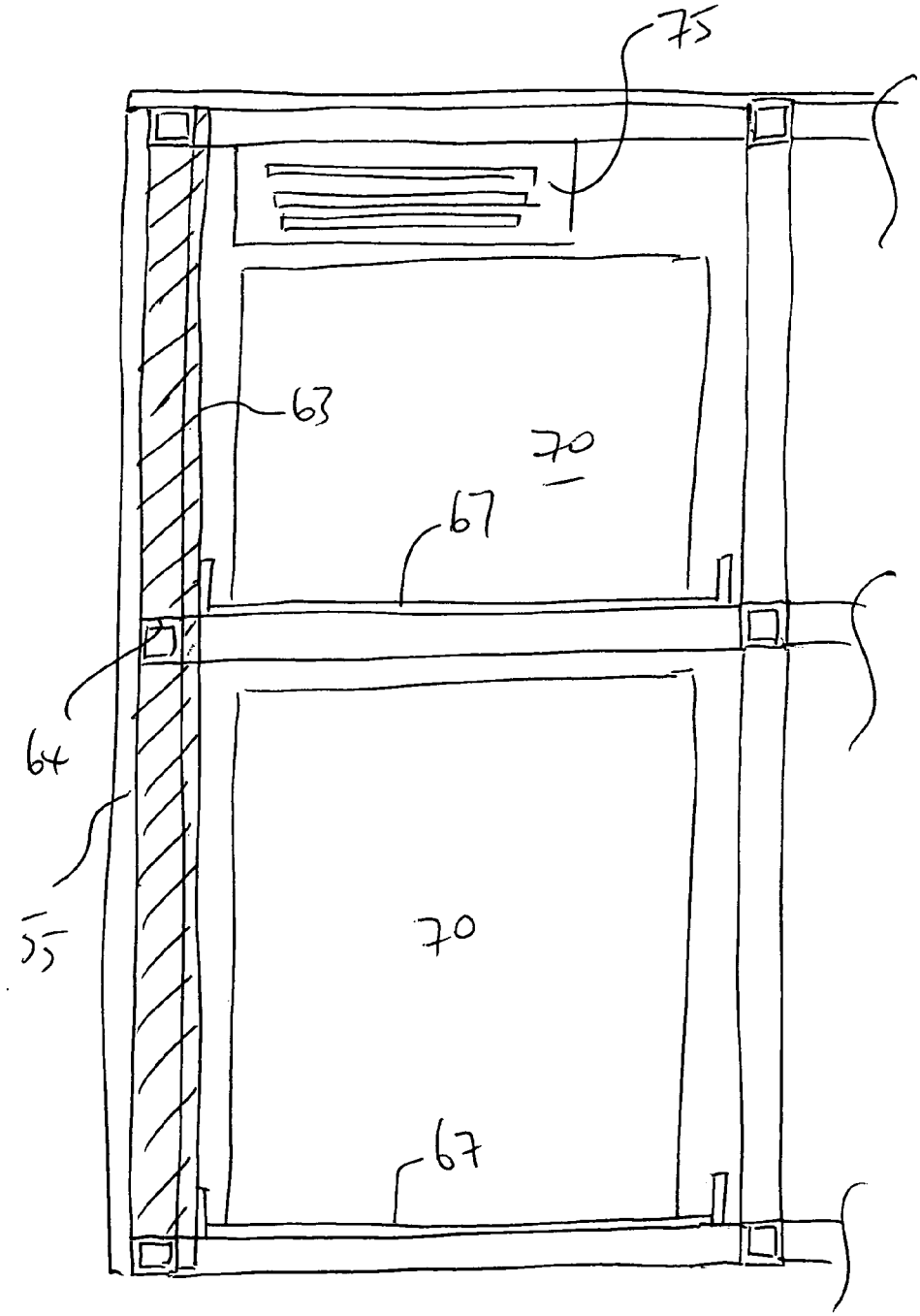
FIG. 5 is a vertical cross sectional view of the modular including the insulation panels on the interior and showing the compartment base and a central cooling system of an alternative embodiment.

As alternative shown in FIG. 5, the simple collapsible racks indicated at 70 are placed on the base 67 without any of the cooling containers so that the whole of the interior is filled by the collapsible racks 70. The whole of the interior is then cooled by a conventional evaporative cooling system schematically indicated at 75.

This arrangement which avoids the use of the independent cooling containers has the advantage that it is modular so as to allow the user to purchase a single structure utilizing a single cooling system and then to add to that structure simply by adding additional modules with each module formed by a rack, insulation, additional paneling and a door.

Generally the cooling system which is available for arrangements of this type has sufficient capacity to satisfy the cooling for a number of modules so that the modules can be increased as required. For very large systems it is possible to add additional cooling unit(s) according to final size and configuration.

The invention claimed is:

1. A wine storage apparatus comprising:

a modular frame defined by upright members and cross members arranged to form a three dimensional array with a front face and a rear face spaced rearwardly from the front face;

the modular frame defining a plurality of rectangular sections arranged side by side with adjacent ones of the rectangular sections attached to one another;

outer panels mounted at least on sides of the modular frame for closing the sides of the modular frame to form an enclosure;

a plurality of wine bottle storing members shaped and arranged to be received in the enclosure;

a cooling system for cooling at least one portion of the enclosure; and the adjacent ones of the rectanaular sections being selectively detachable from one another such that additional members can be connected to the modular frame between the adjacent rectangular sections to form an additional rectangular section and expand the modular frame thereby expanding the enclosure between the outer panels on the sides of the modular frame.

2. The wine storage apparatus according to claim 1 wherein the at least one portion of the enclosure is closable by at least one door.

3. The wine storage apparatus according to claim 1 wherein at least some of the upright members have interconnections therebetween allowing division of at least one of the rectangular sections to form compartments one atop another in a row with each compartment having an open front at the front face of the modular frame.

4. The wine storage apparatus according to claim 3 wherein there is provided a plurality of independent wine cooling containers each comprising:

an insulated rectangular housing having an open front;

the housing being shaped and arranged so as to fit into a respective one of the compartments;

the housing being arranged so that it is readily removable from the compartment;

an array of bottle mounting members within the housing for stacking a plurality of wine bottles within the housing for insertion and removal through the front of the housing;

a door on the front of the housing arranged to allow opening of the door and access to the wine bottles within the container while the container is within the compartment;

and a cooling element associated with the housing for cooling the wine bottles within the housing, the cooling element being independent of cooling elements in others of the housings;

whereby the cooling system is formed by the individual cooling elements of the plurality of cooling containers.

5. The wine storage apparatus according to claim 4 wherein each of the wine cooling containers has the cooling element mounted within the insulated housing.

6. The wine storage apparatus according to claim 5 wherein the cooling element includes a semi-conductor or other cooling component.

7. The wine storage apparatus according to claim 4 wherein there is provided an electrical connection arrangement for supplying electrical power to the cooling element of each of the housings and the electrical connection is modular so as to provide an electrical outlet for each compartment and a single electrical connection to an electrical power outlet.

8. The wine storage apparatus according to claim 7 wherein the electrical connection is mounted in or associated with the modular frame so as to be part of the modular frame.

9. The wine storage apparatus according claim 4 wherein each wine cooling container is arranged as a sliding fit within the respective compartment so as to be slidable from the front into the compartment to be wholly contained therein.

10. The wine storage apparatus according to claim 9 wherein the compartments are arranged relative to the electrical connection such that sliding of a housing into its compartment causes engagement with the electrical connection of that compartment.

11. The wine storage apparatus according to claim 4 wherein the containers are arranged side by side and top to bottom such that the doors cover substantially the whole front face.

12. The wine storage apparatus according to claim 4 wherein the compartments are arranged in an array of rows and columns such that the doors cover substantially the whole front face.

13. The wine storage apparatus according to claim 4 wherein the doors are formed of glass.

14. The wine storage apparatus according to claim 4 wherein there are provided additional wine storage compartments which are not cooled wherein the compartment can be filled with one or more wine cells and/or one or more additional wine racks each in its respective compartment.

15. The wine storage apparatus according to claim 14 wherein each additional wine storage compartment comprises a foldable or collapsible rack which can be readily assembled to form a rectangular structure matching the size of a compartment.

16. The wine storage apparatus according to claim 1 wherein each rectangular section of the modular frame is closable by a respective front door.

17. The wine storage apparatus according to claim 16 wherein the outer panels are insulated.

18. The wine storage apparatus according to claim 17 wherein the outer panels are insulated by boards of insulation material applied over the modular frame with grooves formed in the boards for receiving the cross members.

19. The wine storage apparatus according to claim 16 wherein there is provided a central cooling system for cooling the enclosure in entirety.

* * * * *